US008798501B2

(12) United States Patent
Hayashi et al.

(10) Patent No.: US 8,798,501 B2
(45) Date of Patent: Aug. 5, 2014

(54) COVER MEMBER AND CARTRIDGE

(75) Inventors: Naoki Hayashi, Kawasaki (JP); Shigeo Miyabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/558,205

(22) Filed: Jul. 25, 2012

(65) Prior Publication Data

US 2013/0028635 A1 Jan. 31, 2013

(30) Foreign Application Priority Data

Jul. 29, 2011 (JP) ..... 2011-166759

(51) Int. Cl.
*G03G 15/08* (2006.01)
*G03G 21/16* (2006.01)

(52) U.S. Cl.
CPC ..... *G03G 15/0896* (2013.01); *G03G 2221/163* (2013.01); *G03G 2221/1654* (2013.01); *G03G 21/16* (2013.01); *G03G 2215/0177* (2013.01)
USPC ..... 399/119

(58) Field of Classification Search
CPC ..... G03G 15/00
USPC ..... 399/119, 114
See application file for complete search history.

(56) References Cited

U.S. PATENT DOCUMENTS 4,713,673 A * 12/1987 Kessoku ..... 399/227
5,497,220 A * 3/1996 Inomata et al. ..... 399/120
5,585,598 A * 12/1996 Kasahara et al. ..... 399/227
5,617,188 A * 4/1997 Inomata ..... 399/13
5,646,721 A * 7/1997 Sugihara et al. ..... 399/176
5,809,380 A * 9/1998 Katakabe et al. ..... 399/227
6,047,150 A * 4/2000 Kanno et al. ..... 399/119
6,137,975 A * 10/2000 Harumoto et al. ..... 399/227
6,298,203 B1 * 10/2001 Hashimoto et al. ..... 399/119
6,535,709 B2 * 3/2003 Yokomori et al. ..... 399/274
6,560,422 B2 * 5/2003 Kanno et al. ..... 399/106
6,782,219 B2 * 8/2004 Yoshino et al. ..... 399/90
6,961,528 B2 * 11/2005 Yamaguchi et al. ..... 399/119
7,058,340 B2 * 6/2006 Tanaka ..... 399/227
8,233,821 B2 * 7/2012 Miyabe et al. ..... 399/119
8,326,178 B2 * 12/2012 Nakamura et al. ..... 399/114
8,369,748 B2 * 2/2013 Ueno et al. ..... 399/227

(Continued)

FOREIGN PATENT DOCUMENTS

JP 2000-019839 * 1/2000 ..... G03G 15/00
JP 2000-019839 A 1/2000
JP 2004-264757 * 9/2004 ..... G03G 15/08
JP 2004-264757 A 9/2004

OTHER PUBLICATIONS

European Patent Office (EPO); European Search Report, Form 1503 03.82 (P04C01), Berlin, Germany, Jul. 15, 1999.*

*Primary Examiner* — Clayton E Laballe
*Assistant Examiner* — Kevin Butler
(74) *Attorney, Agent, or Firm* — Canon USA Inc IP Division

(57) ABSTRACT

A cover member is mounted on a cartridge including a developer bearing member for providing a developer for developing an electrostatic latent image, and a grip portion to be gripped, and cover an exposed part of the developer bearing member exposed outside a frame member of the cartridge includes a portion configured to partition a space between the grip portion and the exposed part when the cover member is mounted on the cartridge.

17 Claims, 11 Drawing Sheets

(56) References Cited

U.S. PATENT DOCUMENTS

| | | | | |
|---|---|---|---|---|
| 8,391,748 | B2 * | 3/2013 | Miyabe et al. | 399/119 |
| 8,521,060 | B2 * | 8/2013 | Numata et al. | 399/111 |
| 2008/0286010 | A1 * | 11/2008 | Aoki et al. | 399/227 |
| 2009/0317134 | A1 * | 12/2009 | Miyabe et al. | 399/119 |
| 2009/0317135 | A1 * | 12/2009 | Miyabe et al. | 399/119 |
| 2010/0054805 | A1 * | 3/2010 | Numata et al. | 399/119 |
| 2010/0054823 | A1 * | 3/2010 | Takasaka et al. | 399/286 |
| 2012/0195635 | A1 * | 8/2012 | Miyabe et al. | 399/119 |
| 2013/0094882 | A1 * | 4/2013 | Miyabe et al. | 399/119 |

* cited by examiner

COVER MEMBER AND CARTRIDGE

This application claims priority from Japanese Patent Application No. 2011-166759 filed Jul. 29, 2011, which is hereby incorporated by reference herein in its entirety.

BACKGROUND OF THE INVENTION

1. Field of the Invention

The present disclosure relates to a cartridge removably mounted in a main assembly of an image forming apparatus, and a cover member mounted on the cartridge.

2. Description of the Related Art

In an image forming apparatus, such as a copying machine, printer, and facsimile machine, that uses electrophotographic image-forming process, an electrostatic latent image formed on an image bearing member, such as a photosensitive drum, is developed by a developing unit for visualization as a toner image. In conventionally known image forming apparatuses using such electrophotographic image-forming process, a developing unit formed as a cartridge (a developing cartridge), is removably mounted in a main assembly of the image forming apparatus. Since the developing unit is provided as the cartridge, a user can replace the developing unit.

In some developing cartridges, a developing roller, which carries a developer for developing an electrostatic latent image on an image bearing member, is partially exposed outside a frame of the developing cartridge. Such developing cartridges may be provided with a cover member that covers the exposed part of the developing roller to protect the developing roller during transportation (see Japanese Patent Application Laid-Open No. 2004-264757).

A cover member for covering a developing roller is discussed in Japanese Patent Application Laid-Open No. 2000-019839. In the configuration discussed in Japanese Patent Application Laid-Open No. 2000-019839, a cover has a sealing member made of urethane foam. When the cover member covers an exposed part of a developing roller, space formed between a peripheral portion of the exposed part and the cover member is filled with the sealing member, thereby preventing leaking of a developer from the exposed part into the surrounding area.

During transportation of a developing cartridge, a developer may leak from the inside of the developing cartridge due to physical shock applied to the developing cartridge. Also, at the time of start of using a developing cartridge, friction is generated between a developing roller and a developer supply roller which supplies a developer to the developing roller. To reduce such friction, the developer may be applied in advance to the developing roller and the developer supply roller. The developer may run off the developing roller at an exposed part during transportation of the developing cartridge, and may flow between the developing cartridge and a cover mounted on the developing cartridge, and then to a grip portion of the developing cartridge. The developer adhering to the grip portion can stain the user's hands.

If a sealing member is provided to the cover to surround the peripheral portion of the exposed part of the developing roller as discussed in Japanese Patent Application Laid-Open No. 2000-019839, the number of components is increased.

SUMMARY OF THE INVENTION

The present disclosure is directed to preventing, with a simple configuration, adhesion of a developer to a grip portion of a cartridge which is provided with a cover for covering a developer bearing member, during transportation of the cartridge.

According to an aspect disclosed herein, a cover is mounted on a cartridge including a developer bearing member for providing a developer for developing an electrostatic latent image, and a grip portion to be gripped and cover an exposed part of the developer bearing member exposed outside a frame member of the cartridge, includes a portion configured to partition a space between the grip portion and the exposed part when the cover is mounted on the cartridge.

According to another aspect of the present invention, a cartridge includes a developer bearing member for providing a developer for developing an electrostatic latent image, and a grip portion to be gripped. A cover member is mounted on the cartridge. The cover member covers an exposed part of the developer bearing member exposed outside a frame member of the cartridge, and includes a portion partitioning a space between the grip portion and the exposed part.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Figure 1:
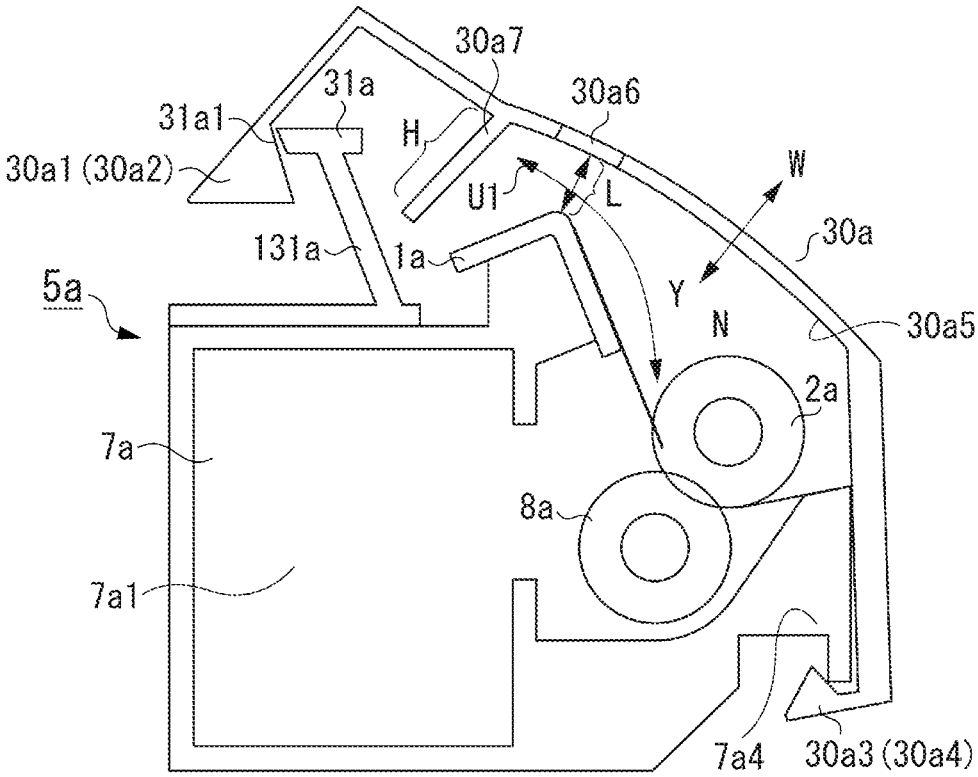
FIG. 1 is a cross-sectional view schematically illustrating a developing cartridge with a cover mounted thereon.

Various exemplary embodiments, features, and aspects will be described in detail below with reference to the drawings.

Referring to the drawings, exemplary embodiments of the present disclosure will be described in detail below with reference to a so-called rotary-type color image forming apparatus that includes a rotary in which a plurality of developing cartridges can be mounted.

<Entire Configuration of Image Forming Apparatus>

Figure 2:
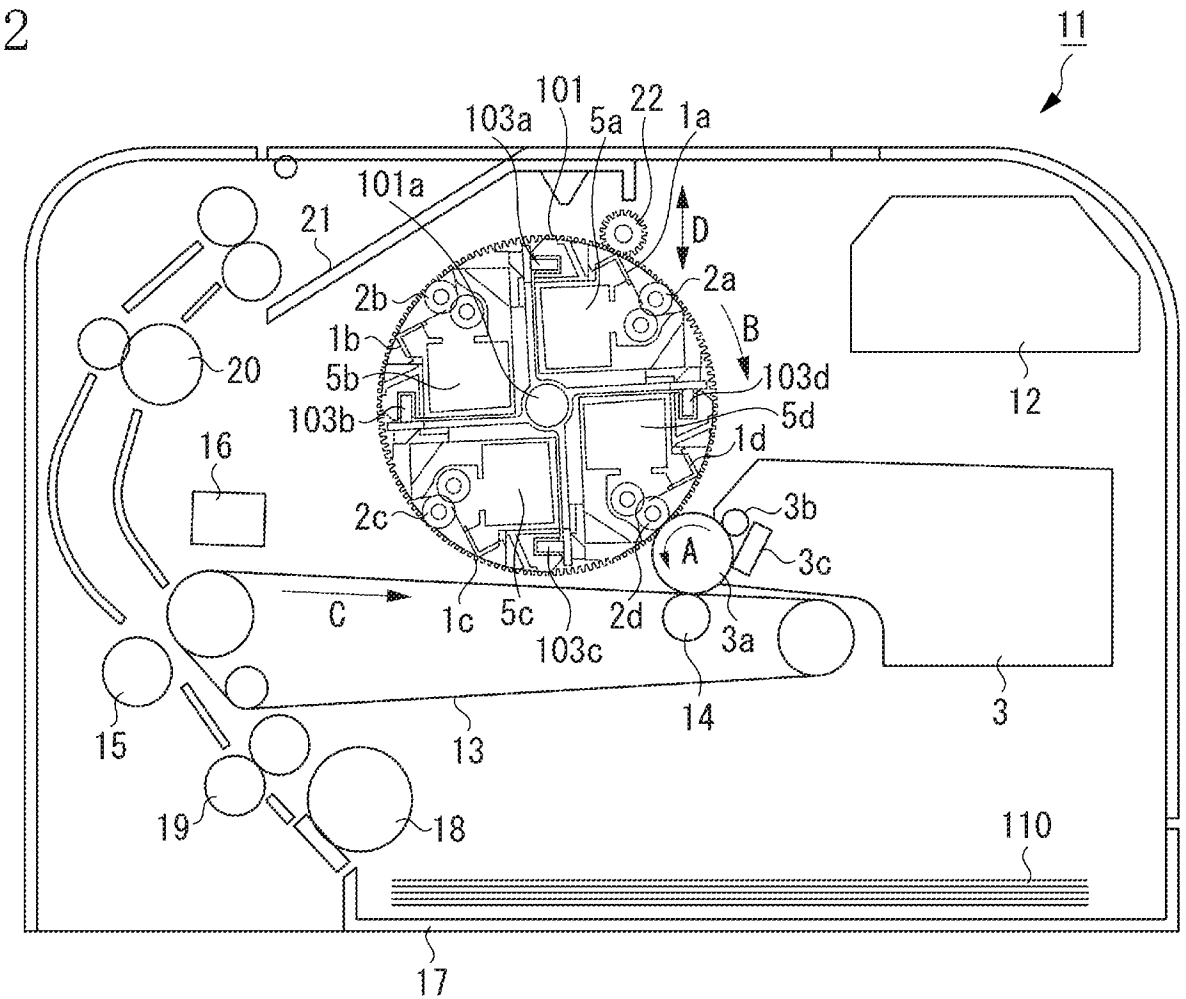
FIG. 2 is a cross-sectional view schematically illustrating an example of an image forming apparatus.

First, image-forming operation of the image forming apparatus will be described with reference to FIG. 2. The image forming apparatus 11 according to an exemplary embodiment of the present disclosure is a full-color (four-color) laser-beam printer. FIG. 2 is a cross-sectional view schematically illustrating the configuration of the image forming apparatus 11.

As illustrated in FIG. 2, the image forming apparatus 11 includes a photosensitive drum 3*a* serving as an image bearing member. A charging unit 3*b*, an exposure unit 12, a developing unit, and a cleaning unit 3*c* are disposed around the photosensitive drum 3*a*. The charging unit 3*b* uniformly charges the photosensitive drum 3*a*. The exposure unit 12 applies a laser beam onto the photosensitive drum 3*a* to form an electrostatic latent image. The developing unit develops the electrostatic latent image formed on the photosensitive drum 3*a*. The cleaning unit 3*c* removes residual toner on the photosensitive drum 3*a*.

The developing unit according to the present exemplary embodiment is composed of a yellow developing cartridge 5*a*, a magenta developing cartridge 5*b*, a cyan developing cartridge 5*c*, and a black developing cartridge 5*d*. The developing cartridges 5*a*, 5*b*, 5*c*, and 5*d* are each used to develop and visualize an electrostatic latent image on the photosensitive drum 3*a* with a developer (toner) of a corresponding color. The developing cartridges 5*a*, 5*b*, 5*c*, and 5*d* are removably mounted in a main assembly of the image forming apparatus 11 (an image forming apparatus main assembly). The developing cartridges 5*a*, 5*b*, 5*c*, and 5*d* include developing rollers 2*a*, 2*b*, 2*c*, and 2*d*, respectively. The developing rollers 2*a*, 2*b*, 2*c*, and 2*d* serve as developer bearing members for carrying the respective developers. The developing cartridges 5*a*, 5*b*, 5*c*, and 5*d* are held by a rotary 101 which is rotatably mounted in the main assembly of the image forming apparatus 11.

In the present exemplary embodiment, the photosensitive drum 3*a*, the charging unit 3*b*, and the cleaning unit 3*c* integrally form a drum cartridge 3. The drum cartridge 3 is removably mounted in the main assembly of the image forming apparatus 11.

Figure 4:
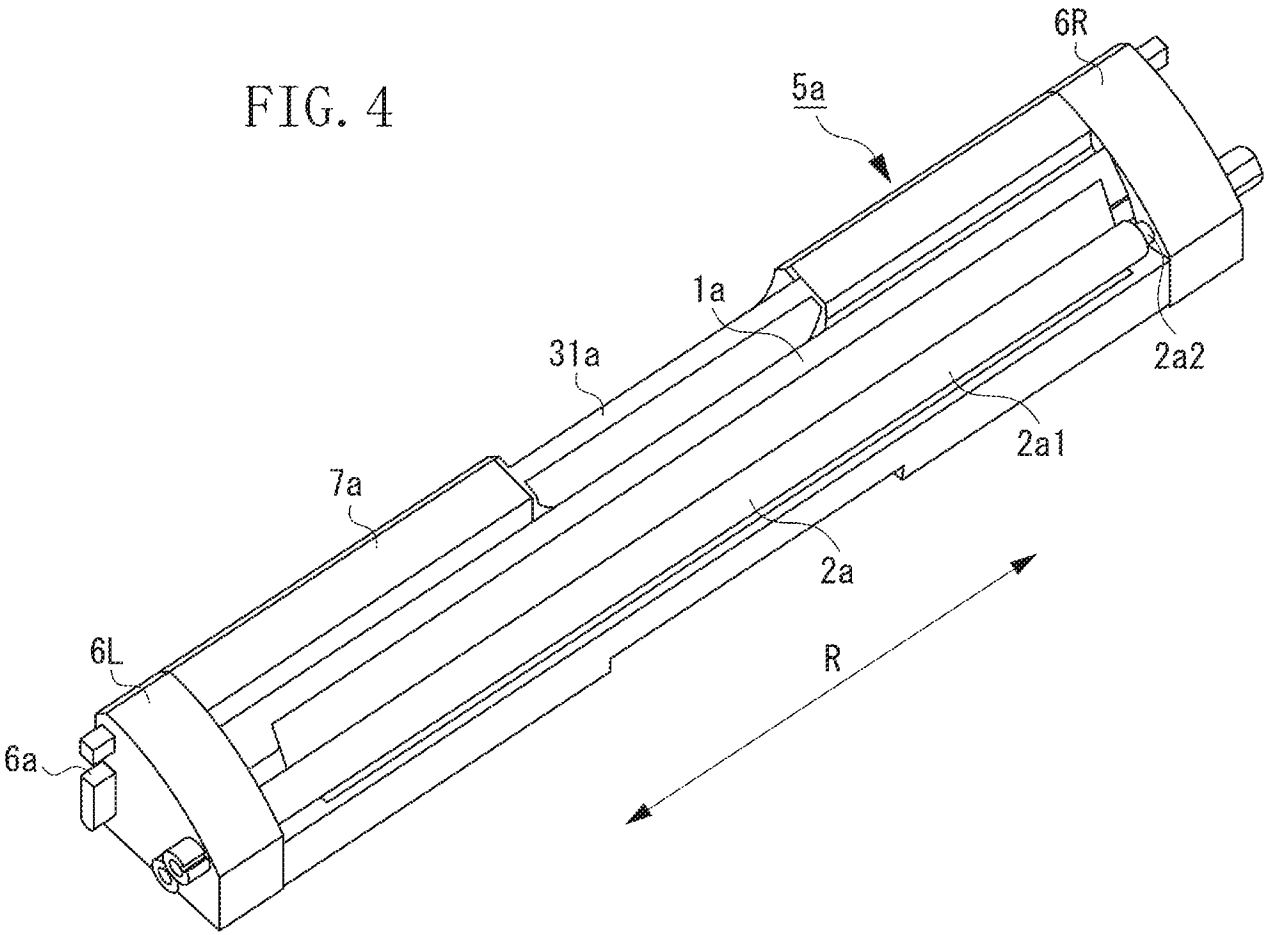
FIG. 4 is a perspective view illustrating the appearance of the developing cartridge.

Next, a configuration in which the rotary 101 holds each developing cartridge will be described. As illustrated in FIG. 4, the yellow developing cartridge 5*a* is provided with a portion 6*a* to be locked. As illustrated in FIG. 2, the rotary 101 is provided with a developing cartridge locking member 103*a*. The locked portion 6*a* of the yellow developing cartridge 5*a* engages with the developing cartridge locking member 103*a*. This engagement restricts movement of the yellow developing cartridge 5*a* in the directions indicated by an arrow D illustrated in FIG. 2, so that the yellow developing cartridge 5*a* is supported by the rotary 101. The magenta developing cartridge 5*b*, the cyan developing cartridge 5*c*, and the black developing cartridge 5*d* have the same configuration as the yellow developing cartridge 5*a*, and are supported by the rotary 101 in the same manner as the yellow developing cartridge 5*a*.

Image formation operation will be described below. First, the photosensitive drum 3*a* is rotated in the direction of an arrow A illustrated in FIG. 2. In synchronization with the rotation of the photosensitive drum 3*a*, an intermediate transfer belt 13 is rotated in the direction of an arrow C illustrated in FIG. 2. The surface of the photosensitive drum 3*a* is then uniformly charged by the charging unit 3*b*, while exposed to light applied by the exposure unit 12, thereby forming an electrostatic latent image on the photosensitive drum 3*a*.

Figure 3:
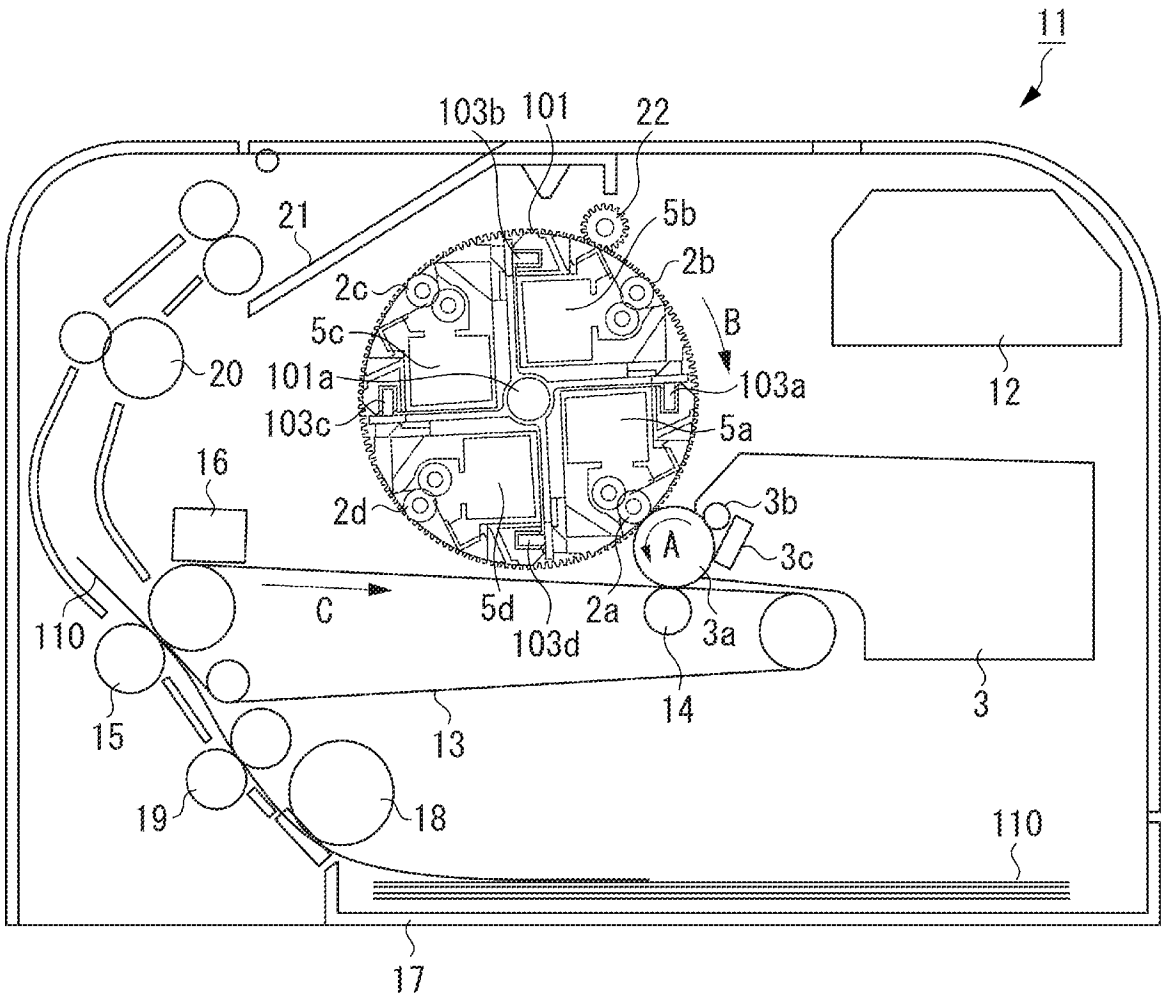
FIG. 3 is a cross-sectional view schematically illustrating an example of the image forming apparatus during image formation.

Upon the formation of the electrostatic latent image, a drive transmission mechanism 22 disposed in the image forming apparatus 11 causes the rotary 101 to rotate about a rotary rotating shaft 101*a* in the direction of an arrow B illustrated in FIG. 2. As illustrated in FIG. 3, as a result of the rotation of the rotary 101, the yellow developing cartridge 5*a* is located in a development position facing the photosensitive drum 3*a*.

The image forming apparatus 11 then generates a potential difference between the photosensitive drum 3*a* and the developing roller 2*a* so that the yellow toner adheres to the electrostatic latent image formed on the photosensitive drum 3*a*. The yellow toner thus adheres to the electrostatic latent image formed on the photosensitive drum 3*a*, thereby developing the electrostatic latent image. In other words, a yellow toner image is formed on the photosensitive drum 3*a*.

The image forming apparatus 11 then applies a voltage, which is opposite in polarity to the polarity of the toner, to a primary transfer roller 14 disposed on the inner side of the intermediate transfer belt 13. Consequently, the yellow toner image on the photosensitive drum 3*a* is primarily transferred onto the intermediate transfer belt 13.

When the primary transfer of the yellow toner image is completed in this manner, the rotary 101 is driven by the drive transmission mechanism 22 to rotate further in the direction of the arrow B. With this rotational movement of the rotary 101, the magenta developing cartridge 5*b*, the cyan developing cartridge 5*c*, and the black developing cartridge 5*d* are sequentially placed in the development position facing the photosensitive drum 3*a*. For each of these colors, magenta, cyan, and black, the formation, development, and primary transfer of an electrostatic latent image are performed in sequence as in the case of yellow. The resultant toner images of the four colors are superimposed on the intermediate transfer belt 13.

As illustrated in FIG. 2, during this process, a secondary transfer roller 15 is not in contact with the intermediate transfer belt 13. A cleaning unit 16 for the intermediate transfer belt 13 is also in a position where the cleaning unit 16 does not contact the intermediate transfer belt 13.

A stack of sheets of paper 110 as recording media is accommodated in a sheet feeding cassette 17 in a lower portion of the image forming apparatus 11. Each sheet of paper 110 is picked up from the sheet feeding cassette 17 and fed to conveyance rollers 19 by a sheet feeding roller 18. The conveyance rollers 19 feed the sheet of paper 110 to a space between the intermediate transfer belt 13 and the secondary transfer roller 15. At this time, as illustrated in FIG. 3, the secondary transfer roller 15 is pressed into contact with the intermediate transfer belt 13.

Furthermore, a voltage of a polarity opposite to that of the toner is applied to the secondary transfer roller 15, so that the toner images of the four colors superimposed on the intermediate transfer belt 13 are secondarily transferred onto the surface of the conveyed sheet of paper 110.

The sheet of paper 110 with the toner images transferred thereon is advanced to a fixing device 20. In the fixing device 20, the sheet of paper 110 is subjected to heat and pressure, so that the toner images are fixed on the sheet of paper 110. The sheet of paper 110 is then ejected from the fixing device 20 into a sheet discharge unit 21 external to the image forming apparatus 11. In this manner, the image is formed on the sheet of paper 110.

<Description of Developing Cartridge>

The yellow developing cartridge 5*a*, the magenta developing cartridge 5*b*, the cyan developing cartridge 5*c*, and the black developing cartridge 5*d* all have the same configuration. Hence, referring to FIGS. 5A, 5B, 6A, 6B, and 6C, the configuration of the developing cartridges according to the present exemplary embodiment will be described with reference to the yellow developing cartridge 5*a* as a representative example. The yellow developing cartridge 5*a* will be hereinafter referred to simply as the cartridge 5*a*.

Figure 5A:
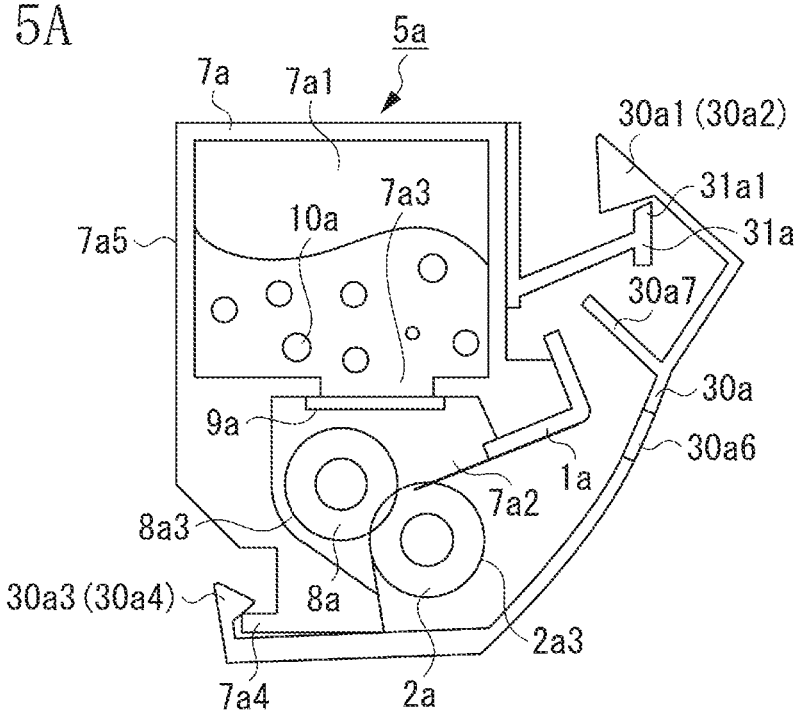
FIGS. 5A and 5B are cross-sectional views schematically illustrating the developing cartridge.
Figure 5B:
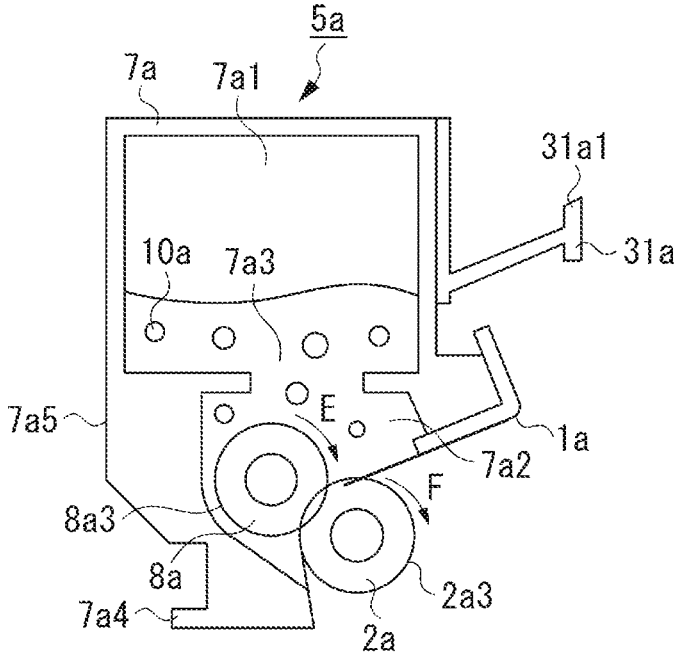
Figure 6A:
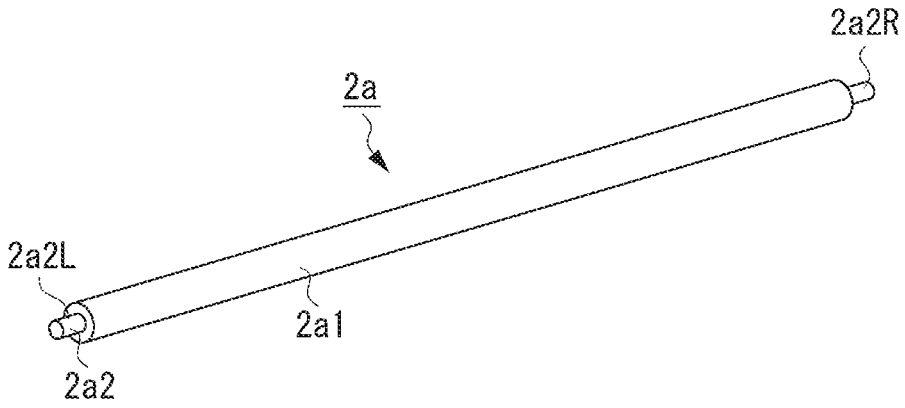
FIGS. 6A, 6B, and 6C schematically illustrate a developing roller and a toner supply roller.
Figure 6B:
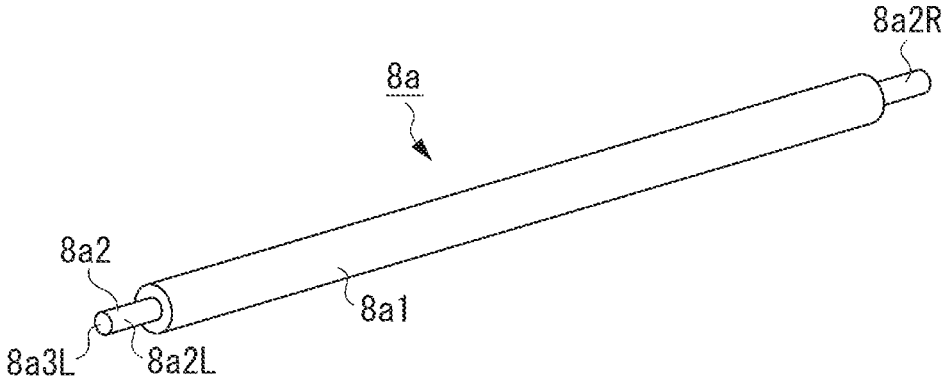
Figure 6C:
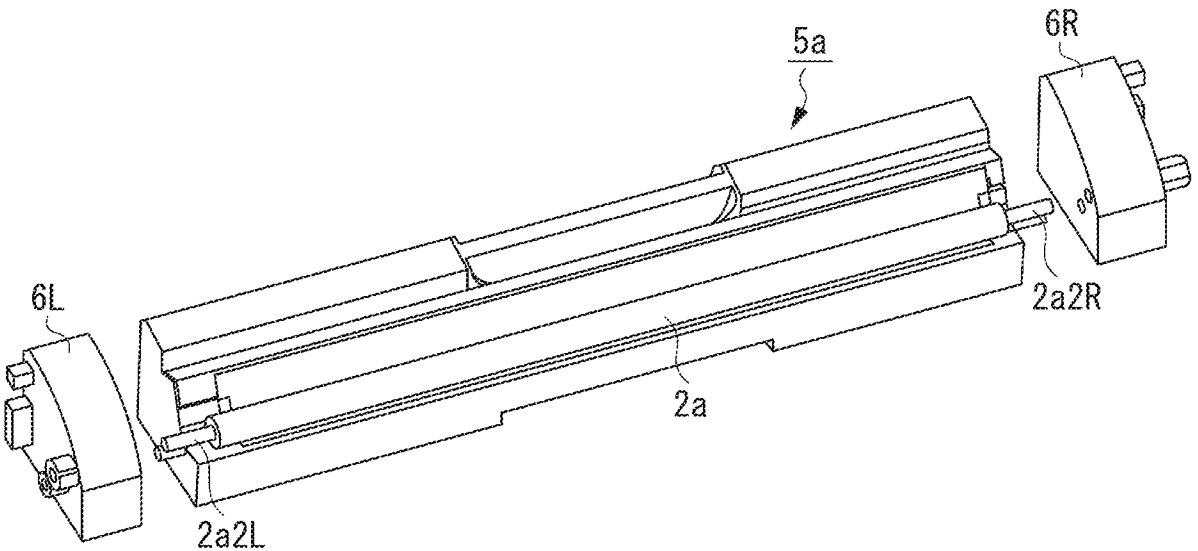

FIGS. 5A and 5B are cross-sectional views illustrating the cartridge 5*a*. The cross-sectional views in FIGS. 5A and 5B are perpendicular to the rotational axis of the developing roller 2*a*, and pass through approximately the center of the cartridge 5*a* in the longitudinal direction (i.e., the direction along the rotational axis) of the developing roller 2*a*. FIG. 6A schematically illustrates the developing roller 2*a* according to the present exemplary embodiment. FIG. 6B schematically illustrates a toner supply roller 8*a* according to the present exemplary embodiment. FIG. 6C schematically illustrates the cartridge 5*a* supporting the developing roller 2*a*.

In the following description, the longitudinal direction of the developing roller 2*a* may be referred to simply as the longitudinal direction.

As illustrated in FIG. 6A, the developing roller 2*a* serving as a developer bearing member is composed of a rubber roller portion 2*a*1 and a rigid shaft 2*a*2. The rigid shaft 2*a*2 passes through the rubber roller portion 2*a*1 in a direction along the rotational axis of the developing roller 2*a*. Both ends of the rigid shaft 2*a*2 form projection portions 2*a*2L and 2*a*2R that protrude from the rubber roller portion 2*a*1.

The toner supply roller 8*a* is a developer supply member which supplies a developer (toner) to the developing roller 2*a*. As illustrated in FIG. 6B, the toner supply roller 8*a* is composed of a sponge roller portion 8*a*1 and a rigid shaft 8*a*2. The rigid shaft 8*a*2 passes through the sponge roller portion 8*a*1 in a direction along the rotational axis of the toner supply roller 8*a*. Both ends of the rigid shaft 8*a*2 form projection portions 8*a*2L and 8*a*2R that protrude from the sponge roller portion 8*a*1.

As illustrated in FIG. 6C, the developing cartridge 5*a* holds the projection portions 2*a*2L and 2*a*2R of the developing roller 2*a* with respective side members 6L and 6R in such a manner as to allow rotation of the developing roller 2*a* and the toner supply roller 8*a*.

A developer container 7*a* which is a frame member of the cartridge 5*a*, is divided into a toner container 7*a*1, which accommodates a toner, and a development chamber 7*a*2, which supports the developing roller 2*a* and the toner supply roller 8*a*. The toner container 7*a*1 and the development chamber 7*a*2 are connected through a toner supply opening 7*a*3.

A rubber roller outer circumferential surface 2*a*3 of the developing roller 2*a* is partially exposed outside the developer container 7*a*. Thus, a user may touch the exposed part with hands. To avoid this, while the cartridge 5*a* is unused until it reaches the user, a cover 30*a* for covering the entire exposed part of the developing roller 2*a* is provided on the cartridge 5*a* as illustrated in FIG. 5A. The cover 30*a* is removed from the cartridge 5*a* when the cartridge 5*a* is mounted in the main assembly of the image forming apparatus 11. As illustrated in FIG. 3, when the developing cartridge 5*a* is mounted, the rubber roller outer circumferential surface 2*a*3 of the developing roller 2*a* contacts the photosensitive drum 3*a*.

As illustrated in FIG. 5A, in the present exemplary embodiment, while the cartridge 5*a* is unused, a toner seal 9*a* in the form of a film is fixed to the developer container 7*a* at the toner supply opening 7*a*3 to separate the toner container 7*a*1 and the development chamber 7*a*2 by heat-welding or the like. As illustrated in FIG. 5B, the toner seal 9*a* is removed prior to use and toner 10*a* within the toner container 7*a*1 is supplied into the development chamber 7*a*2.

In the cartridge 5*a*, the sponge roller portion 8*a*1 of the toner supply roller 8*a* is compressed against the developing roller 2*a* and deformed. To be specific, the sponge roller portion 8*a*1 of the toner supply roller 8*a* is in contact with the rubber roller portion 2*a*1 of the developing roller 2*a* with a certain deformation relative to a toner supply roller outer circumferential surface 8*a*3. The toner supply roller 8*a* and the developing roller 2*a* rotate respectively in the directions of arrows E and F illustrated in FIG. 5B maintaining a certain contact pressure therebetween.

Even if the toner seal 9*a* is removed to use the cartridge 5*a*, the toner 10*a* accommodated in the toner container 7*a* does not immediately move to flow between the developing roller 2*a* and the toner supply roller 8*a*. If the developing cartridge 5*a* is used in this state, the developing roller 2*a* and the toner supply roller 8*a* will rotate in opposite directions, in other words, the surfaces thereof will move in the opposite directions, to frictionally slide against each other. Consequently, the friction load may be increased to cause a rupture of the sponge roller portion 8*a*1 of the toner supply roller 8*a*. To avoid this, toner is applied in advance to the developing roller 2*a* and the toner supply roller 8*a* to reduce the friction load. The toner is desirably applied to both the developing roller 2*a* and the toner supply roller 8*a*. Alternatively, the toner may be applied to either the developing roller 2*a* or the toner supply roller 8*a*.

When the toner 10*a* in the development chamber 7*a*2 is supplied to the toner supply roller 8*a*, the toner supply roller 8*a* rotates to supply the toner 10*a* to the developing roller 2*a*. Then, a thin layer of the toner 10*a* is formed on the developing roller 2*a* by a developing blade 1*a* which is in contact with the developing roller 2*a*. In the present exemplary embodiment, the developing blade 1*a* is a developer regulating member which controls the layer thickness of the toner carried by the developing roller 2*a*. In the present exemplary embodiment, the developing blade 1*a* is composed of a sheet member made of metal which contacts the developing roller 2*a*, and a plate (a fixing member) which supports and secures the sheet member to the developer container 7*a*. The toner is then developed in a position where the developing roller 2*a* faces the photosensitive drum 3*a*. After that, the toner supply roller 8*a* removes the residual toner 10*a* remaining on the developing roller 2*a*, while supplying new toner. At this time, the main body of the image forming apparatus 11 supplies a voltage to the developing roller 2*a* to generate a potential difference between the developing roller 2*a* and the photosensitive drum 3*a*. The main body of the image forming apparatus 11 also supplies a voltage to the toner supply roller 8*a*.

<Configuration of Cover Member>

A configuration in which the cover 30*a* engages with the cartridge 5*a* will be described with reference to FIGS. 1, 7, 8, and 9.

Figure 7A:
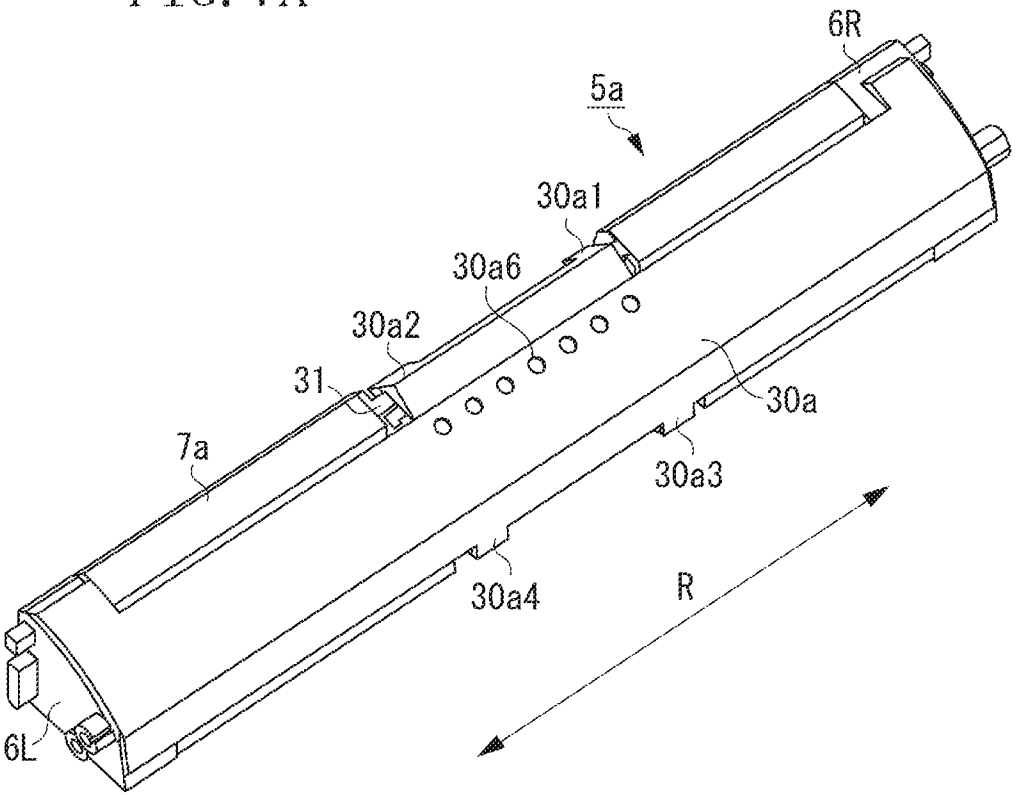
FIGS. 7A and 7B schematically illustrate the developing cartridge and the cover.
Figure 7B:
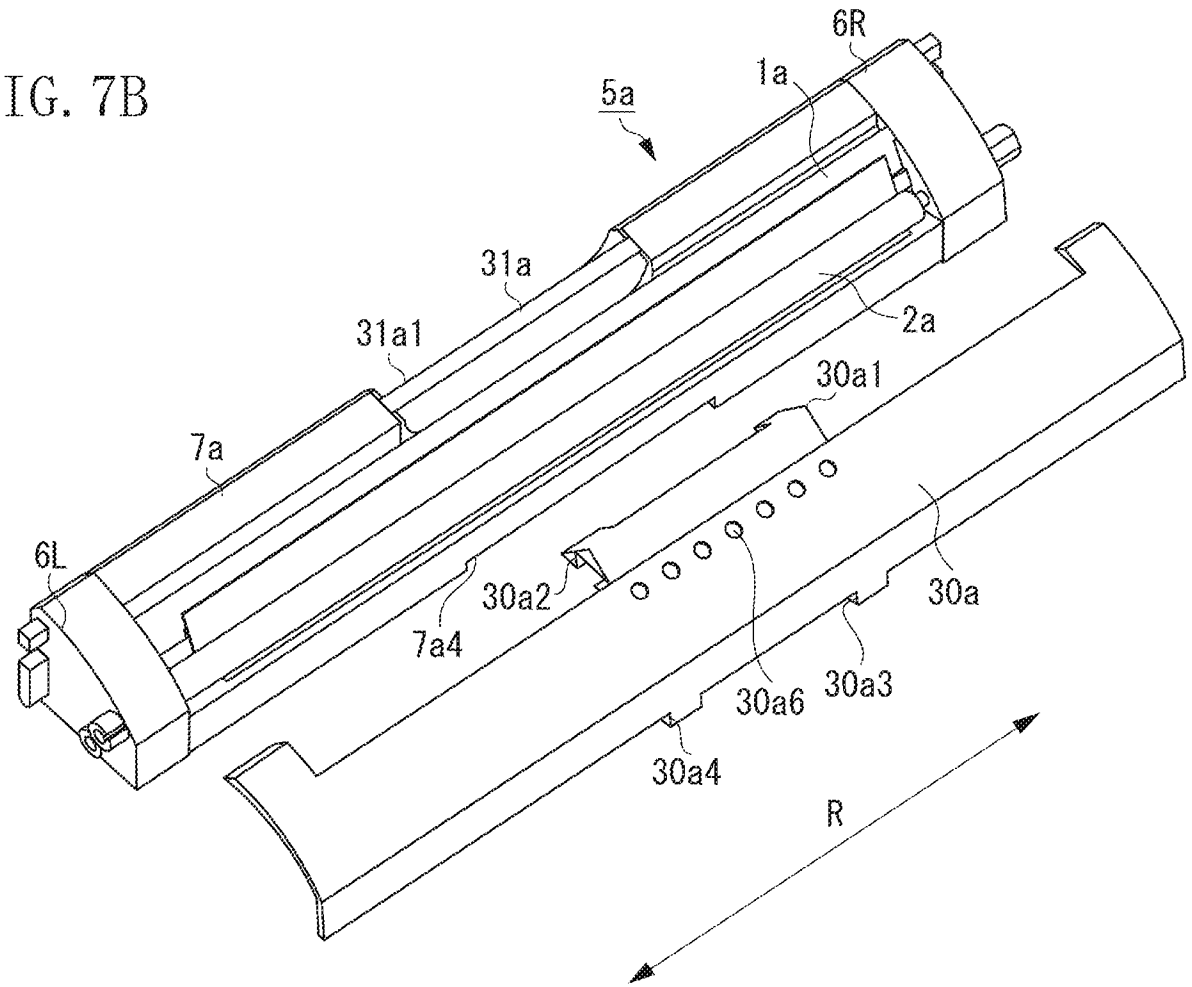
Figure 8:
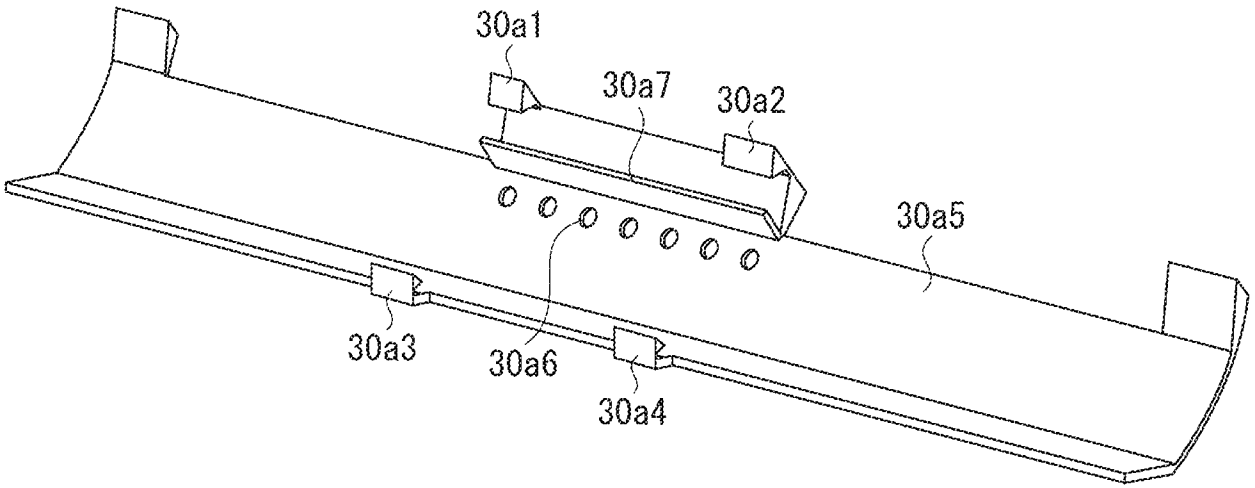
FIG. 8 is a perspective view schematically illustrating the cover.
Figure 9:
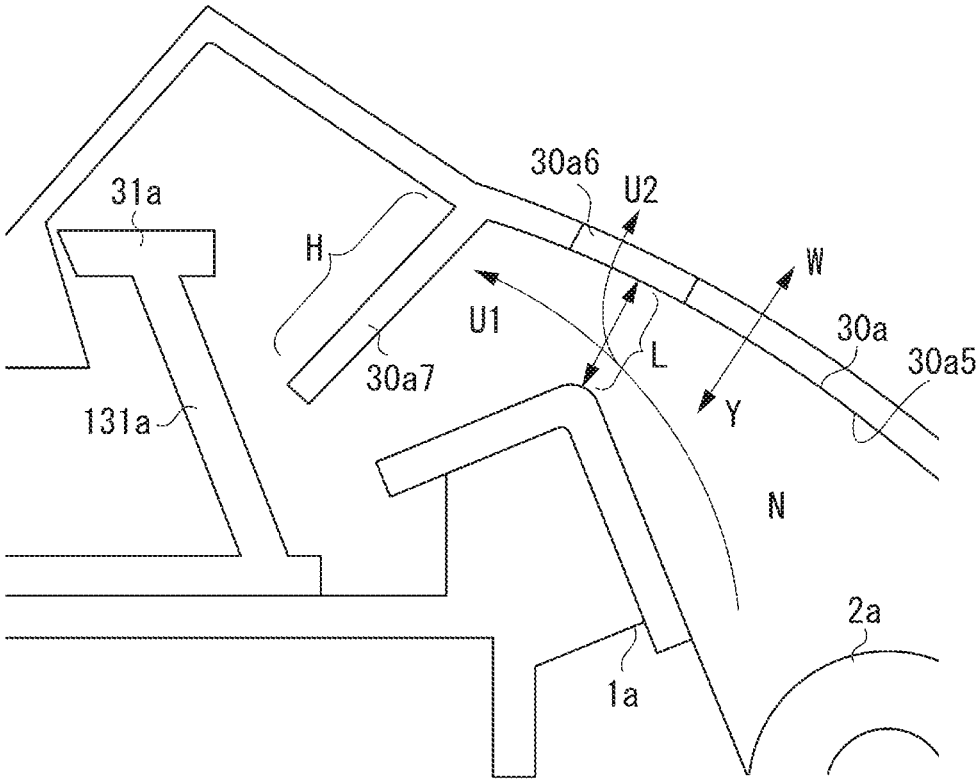
FIG. 9 is an enlarged cross-sectional view schematically illustrating a grip portion of the developing cartridge.

FIG. 1 is a cross-sectional view passing through approximately the center of the cartridge 5*a* in the longitudinal direction (i.e., the direction indicated by an arrow R illustrated in FIG. 7A), and perpendicular to the longitudinal direction. A grip portion 31*a* is provided in a central region of the developer container 7*a* in the longitudinal direction. The grip portion 31*a*, which is a projection in the shape of a wall surface extending in the longitudinal direction, is used by a user to grasp the developing cartridge 5*a*. FIG. 7A is a perspective view illustrating the cartridge 5*a* with the cover 30*a* mounted thereon. FIG. 7B is a perspective view illustrating the developing cartridge 5*a* with the cover 30*a* removed therefrom. FIG. 8 is a perspective view schematically illustrating the cover 30*a*. FIG. 9 is an enlarged view illustrating a part of the cartridge 5*a* in the vicinity of the grip portion 31*a*.

As illustrated in FIG. 7B, the cover 30*a* engages with the cartridge 5*a* at four engaging portions 30*a*1, 30*a*2, 30*a*3, and 30*a*4, which are provided in the vicinity of the center of the cover 30*a* in the longitudinal direction. When the cover 30*a* goes into engagement with the cartridge 5*a*, the engaging portions 30*a*1 and 30*a*2 of the cover 30*a* engage with a portion to be engaged 31*a*1 on the grip portion 31*a*. The engaging portions 30*a*3 and 30*a*4 engage with a portion 7*a*4 to be engaged on the developer container 7*a*. As illustrated in FIG. 7A, with this engagement, the cover 30*a* is mounted on the cartridge 5*a* to cover and protect the exposed part of the developing roller 2*a*. When mounted, the cover 30*a* covers the grip portion 31*a*.

The configuration of the cover 30*a* will be described with reference to FIGS. 1 and 7A. As illustrated in FIGS. 1, 7A, and 8, the cover 30*a* has vent holes 30*a*6. The vent holes 30*a*6 are openings passing though the cover 30*a*. The vent holes 30*a*6 are located where the distance between an inner surface 30*a*5 of the cover 30*a* and the developing blade 1*a* is the shortest when the cover 30*a* is mounted on the developing cartridge 5*a*. In the present exemplary embodiment, the vent holes 30*a*6 are positioned to face the developing blade 1*a* at a distance L. The multiple vent holes 30*a*6 are arranged in the longitudinal direction in an area whose length substantially corresponds to the longitudinal dimension of the grip portion 31*a*.

If a strong physical shock is applied to the cartridge 5*a* during transportation, the toner applied to the developing roller 2*a* and the toner supply roller 8*a* may be scattered into space N illustrated in FIG. 1 from the exposed part of the developing roller 2*a* and from a gap between the developing blade 1*a* and the developing roller 2*a*. The space N is space sandwiched by the inner surface 30*a*5 of the cover 30*a* and the cartridge 5*a*. At this time, the cover 30*a* mounted on the cartridge 5*a* may also undergo the shock, and the inner surface 30*a*5 facing the cartridge 5*a* may move in the directions of arrows Y and W in FIG. 9 relative to the cartridge 5*a*. If the inner surface 30*a*5 moves in the direction of the arrow W, the space N is increased. In this situation, if the inner surface 30*a*5 moves in the direction of the arrow Y, the space N is significantly reduced in size. The significant size reduction causes atmospheric pressure to increase in the space N. Consequently, the scattered toner, together with the air, is forced out of the space N. To be specific, the scattered toner moves, together with the air, in the direction from the exposed part of the developing roller 2*a* toward the grip portion 31*a* (i.e., the direction indicated by an arrow U1 illustrated in FIG. 1).

In the present exemplary embodiment, however, the vent holes 30*a*6 passing through the cover 30*a* are positioned between the exposed part of the developing roller 2*a* and the grip portion 31*a* in the toner moving direction U1. This allows the toner-conveying air to escape through the vent holes 30*a*6 to the outside of the cover 30*a*, more specifically, in the direction indicated by an arrow U2 illustrated in FIG. 9, thereby preventing the toner from moving to the grip portion 31*a*.

In particular, in the present exemplary embodiment, the vent holes 30*a*6 are located where the distance between the inner surface 30*a*5 of the cover 30*a* and the developing blade 1*a* is the shortest. This causes atmospheric pressure to increase in the vicinity of the vent holes 30*a*6. The increased atmospheric pressure encourages the escape of the air to the outside of the cover 30*a* through the vent holes 30*a*6, thereby enabling the toner to be easily expelled, together with the air, to the outside of the cover 30*a*.

In addition, as illustrated in FIGS. 1 and 9, the cover 30*a* is provided with a projection portion (hereinafter referred to as a rib wall) 30*a*7 in the shape of a wall surface protruding in a direction toward the cartridge 5*a* and extending in the longitudinal direction. The rib wall 30*a*7 is located farther away from the exposed part of the developing roller 2*a* and closer to the grip portion 31*a* than the vent holes 30*a*6 in a toner scattering path U. The rib wall 30*a*7 is positioned so as to block the path between the developing roller 2*a* and the grip portion 31*a* when the cover 30*a* is mounted on the cartridge 5*a*. More specifically, the rib wall 30*a* serves as a partitioning portion between the exposed part of the developing roller 2*a* and the grip portion 31*a*. The rib wall 30*a*7 protrudes in the direction toward the developing cartridge 5*a*, which prevents movement, toward the grip portion 31*a*, of the toner that has not been expelled through the vent holes 30*a*6. In other words, the rib wall 30*a*7 prevents adhesion of the toner to the grip portion 31*a*.

In the present exemplary embodiment, the longitudinal dimension of the rib wall 30*a*7 is substantially equal to that of the grip portion 31*a* so as to prevent adhesion of the toner to the grip portion 31*a* more reliably. However, the longitudinal dimension of the rib wall 30*a*7 may be longer than that of the grip portion 31*a*, so long as the rib wall 30*a*7 does not interfere with the developer container 7*a* when the cover 30*a* is mounted on the developing cartridge 5*a*.

Furthermore, the height H of the rib wall 30*a*7 is set to be greater than the distance L between the vent holes 30*a*6 and the developing blade 1*a* when the cover 30*a* is mounted on the developing cartridge 5*a*. The rib wall 30*a*7 having such a height greater than the distance between the vent holes 30*a*6 and the cartridge 5*a* can more easily block the toner that has not been expelled through the vent holes 30*a*6, and thus can more easily prevent the movement of the toner to the grip portion 31*a*.

In the present exemplary embodiment, the rib wall 30*a*7 is located in a position protruding toward the developing blade 1*a* supported by the developer container 7*a*. However, the rib wall 30*a*7 may be located in any other position, so long as the rib wall 30*a*7 protrudes toward the developing cartridge 5*a* to serve as a barrier between the exposed part of the developing roller 2*a* and the developing blade 1*a*. Specifically, the rib wall 30*a*7 may be configured to protrude toward the developer container 7*a* or any member, other than the developing blade 1*a*, that is supported by the developer container 7*a*. In that case, the height of the rib wall 30*a*7 may also be greater than the distance between the vent holes 30*a* and the cartridge 5*a*, in other words, the shortest distance between the vent holes 30*a* and the developer container 7*a* or the member supported by the developer container 7*a*.

In summary, in the present exemplary embodiment, the cover 30*a* that covers the exposed part of the developing roller 2*a* serving as a developer bearing member is removably mounted on the cartridge 5*a*. The cover 30*a* is provided with a partitioning portion (the rib wall 30*a*7) that protrudes in the direction toward the cartridge 5*a* to partition the space between the grip portion 31*a* and the exposed part of the developing roller 2*a*. The cover 30*a* is also provided with openings (the vent holes 30*a*6) passing through the cover 30*a* and located between the rib wall 30*a*7 and the exposed part of the developing roller 2*a*. The cover 30*a* blocks the flow of toner-conveying air with the rib wall 30*a*7, and then causes that air to escape to the outside through the vent holes 30*a*6, thereby preventing the movement of the toner to the grip portion 31*a*. This prevents adhesion of the toner scattered from the inside of the cartridge 5*a* or from the exposed part of the developing roller 2*a* to the grip portion 31*a* due to physical shock during transportation of the cartridge 5*a*.

In the present exemplary embodiment, the cover 30*a* is shaped to cover the grip portion 31*a* of the cartridge 5*a*. Since the toner moving path is formed extending from the exposed part of the developing roller 2*a* to the grip portion 31*a* between the cartridge 5*a* and the cover 30*a*, blocking the toner moving path with the configuration described above is particularly effective. However, even when the grip portion 31*a* is exposed outside the cover 30*a*, toner may be conveyed to the grip portion 31*a* due to a flow of toner-conveying air generated between the cartridge 5*a* and the cover 30*a*. Therefore, blocking the toner moving path by employing the above-described configuration is effective.

Furthermore, according to the present exemplary embodiment, the grip portion 31*a* need not be located away from the developing roller 2*a* to prevent adhesion of toner. Thus, the size of the cartridge 5*a* can be reduced by positioning the grip portion 31*a* and the developing roller 2*a* close to each other.

In the foregoing exemplary embodiment, a rotary-type image forming apparatus which uses a developing cartridge for color printing has been described. However, the present invention is not limited to this embodiment, but may be applied to developing cartridges used in inline-type image forming apparatuses and to developing cartridges for monochromatic printing. The embodiments disclosed herein may also be applied to process cartridges which include an image bearing member and a developer bearing member.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A cover member mounted on a cartridge including a developer bearing member for providing a developer for developing an electrostatic latent image, and a grip portion to be gripped and cover an exposed part of the developer bearing member exposed outside a frame member of the cartridge, the cover member comprising:

a partitioning portion configured to partition a space between the grip portion and the exposed part when the cover member is mounted on the cartridge, and an opening portion configured to be located between the partitioning portion and the exposed part when the cover member is mounted on the cartridge, and configured to pass through the cover member.

2. The cover member according to claim 1, further comprising a plurality of openings as the opening portion, arranged in a longitudinal direction of the developer bearing member.

3. The cover member according to claim 1, further comprising a plurality of openings as the opening portion, arranged in a longitudinal direction of the developer bearing member.

4. The cover member according to claim 1, wherein the partitioning portion extends in a longitudinal direction of the developer bearing member.

5. The cover member according to claim 1, wherein the cover member covers the grip portion when the cover member is mounted on the cartridge.

6. The cover member according to claim 1, further comprising an engaging portion configured to engage with the grip portion.

7. The cover member according to claim 1, wherein the partitioning portion protrudes from the cover member in a direction toward the cartridge.

8. A cartridge comprising a developer bearing member for providing a developer for developing an electrostatic latent image, and a grip portion to be gripped, wherein a cover member is mounted on the cartridge, covering an exposed part of the developer bearing member exposed outside a frame member of the cartridge, and includes a portion partitioning a space between the grip portion and the exposed part, and wherein the cover member includes an opening portion located between the partitioning portion and the exposed part, and configured to pass through the cover member.

9. The cartridge according to claim 8, wherein a height of the partitioning portion is greater than a distance from the opening portion to the cartridge.

10. The cartridge according to claim 8, wherein the cover member includes a plurality of openings as the opening portion, arranged in a longitudinal direction of the developer bearing member.

11. The cartridge according to claim 8, wherein the developer is applied to the developer bearing member when the cartridge is unused.

12. The cartridge according to claim 8, further comprising a developer supply member configured to contact the developer bearing member and supply the developer to the developer bearing member, wherein the developer is applied to at least either the developer bearing member or the developer supply member when the cartridge is unused.

13. The cartridge according to claim 8, wherein the partitioning portion extends in a longitudinal direction of the developer bearing member.

14. The cartridge according to claim 8, wherein the cover member covers the grip portion.

15. The cartridge according to claim 8, wherein the cover member includes an engaging portion configured to engage with the grip portion.

16. The cartridge according to claim 8, wherein the partitioning portion protrudes from the cover member in a direction toward the cartridge.

17. A cartridge comprising a developer bearing member for providing a developer for developing an electrostatic latent image, and a grip portion to be gripped, wherein a cover member is mounted on the cartridge, covering an exposed part of the developer bearing member exposed outside a frame member of the cartridge, and includes a portion partitioning a space between the grip portion and the exposed part;

a developer regulating member configured to regulate a layer thickness of the developer carried by the developer bearing member, wherein the partitioning portion protrudes in a direction toward the developer regulating member.

* * * * *